US008777340B2

(12) United States Patent
Greussing

(10) Patent No.: US 8,777,340 B2
(45) Date of Patent: Jul. 15, 2014

(54) PULL-OUT GUIDE FOR DRAWERS

(75) Inventor: Ulrich Greussing, Bizau (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/300,976

(22) Filed: Nov. 21, 2011

(65) Prior Publication Data

US 2012/0080988 A1 Apr. 5, 2012

Related U.S. Application Data

(63) Continuation of application No. PCT/AT2010/000121, filed on Apr. 21, 2010.

(30) Foreign Application Priority Data

Jun. 10, 2009 (AT) ..... A 895/2009

(51) Int. Cl.
*A47B 88/00* (2006.01)

(52) U.S. Cl.
USPC ..... 312/334.6; 312/334.4; 312/334.5

(58) Field of Classification Search
USPC ..... 312/334.6, 334.27, 334.4, 334.5
See application file for complete search history.

(56) References Cited

U.S. PATENT DOCUMENTS

| | | | | |
|---|---|---|---|---|
| 4,606,588 | A | 8/1986 | Koch | |
| 5,306,080 | A * | 4/1994 | Lautenschlager et al. | 312/334.5 |
| 8,220,884 | B2 * | 7/2012 | Berger | 312/334.4 |
| 2001/0019235 | A1 * | 9/2001 | Hammerle | 312/334.4 |
| 2003/0234603 | A1 * | 12/2003 | Salice | 312/334.5 |
| 2004/0239219 | A1 | 12/2004 | Kim et al. | |
| 2009/0167128 | A1 | 7/2009 | Berger | |

FOREIGN PATENT DOCUMENTS

| | | | |
|---|---|---|---|
| AT | 320 203 | 1/1975 | |
| AT | 395 097 | 9/1992 | |
| DE | 82 28 143 | 1/1983 | |
| DE | 20 2006 003 035 | 8/2007 | |
| DE | 20 2007 014 954 | 1/2009 | |
| EP | 0 158 811 | 10/1985 | |
| EP | 1 147 725 | 10/2001 | |
| EP | 1621107 A1 * | 2/2006 | A47B 88/04 |

(Continued)

OTHER PUBLICATIONS

Machine Translation of DE 20 2007 014 954 U1.*

(Continued)

*Primary Examiner* — Darnell Jayne
*Assistant Examiner* — Andrew Roersma
(74) *Attorney, Agent, or Firm* — Wenderoth, Lind & Ponack, L.L.P.

(57) ABSTRACT

A pull-out guide for drawers includes a body rail to be fastened to a furniture body and at least one pull-out rail that can be moved relative to the body rail. The guide also includes an adjustment device by which a position of a drawer that is connected or can be connected to the pull-out rail can be adjusted. The adjustment device includes at least one retaining pin that can be inserted in a provided borehole of the drawer and a bearing part mounted on the pull-out rail. The bearing part is arranged at the rear end of the pull-out rail and extends at a distance to an upper side of the pull-out rail in a substantially horizontal direction in the longitudinal direction of the pull-out rail, wherein the bearing part is mounted adjustably inside the retaining pin.

13 Claims, 5 Drawing Sheets

(56) References Cited

FOREIGN PATENT DOCUMENTS

| | | | | |
|---|---|---|---|---|
| JP | 2006-526479 | | 11/2006 | |
| WO | 2007/096156 | | 8/2007 | |
| WO | 2009/056326 | | 5/2009 | |
| WO | WO 2009149479 | A1 * | 12/2009 | ..... A47B 88/04 |

OTHER PUBLICATIONS

Machine Translation of WO 2009/149479 A1.*

International Search Report issued Sep. 13, 2010 in International (PCT) Application No. PCT/AT2010/000121.

Austrian Patent Office Search Report issued Feb. 26, 2010 in Austrian Patent Application No. A895/2009.

* cited by examiner

PULL-OUT GUIDE FOR DRAWERS

This application is a Continuation of International Application No. PCT/AT2010/000121, filed Apr. 21, 2010, the entire disclosure of which is incorporated herein by reference.

BACKGROUND OF THE INVENTION

The present invention concerns a pull-out guide for drawers, comprising a carcass rail to be fixed to a furniture carcass and at least one extension rail displaceable relative to the carcass rail, and an adjusting device by which a position of a drawer which is or can be connected to the extension rail is adjustable. The adjusting device has at least one holding projection which can be fitted in a provided bore in the drawer, and a mounting portion is mounted at the extension rail. The mounting portion is arranged at the rear end of the extension rail and extends in spaced relationship with a top side of the extension rail in a substantially horizontal direction in the longitudinal direction of the extension rail.

The invention further concerns a drawer and an article of furniture having a drawer pull-out guide of the kind to be described.

EP 1 147 725 B1 to the present applicant discloses a pull-out guide assembly for drawers of the general kind set forth, wherein the rearward end of a drawer can be connected to the drawer extension rail without the use of a tool by a mounting portion which is mounted to the extension rail and which is in the form of a holding nose. The holding nose is arranged at an inward end of the extension rail and extends in a substantially parallel spaced relationship relative to the top side thereof. Mounting and removal of the rearward end of the drawer relative to the extension rail is effected by pushing the drawer onto the holding nose or pulling it back therefrom. After mounting has been effected by pushing the drawer onto the holding nose, the drawer is secured at its rear end region against lifting and against lateral displacement. In order to permit inclination of the front panel of a drawer which has already been mounted in position without a substantial change of the height position of the front panel relative to the carcass, EP 1 147 725 B1 proposes making the holding nose adjustable in the heightwise direction.

DE 20 2006 003 035 U1 and DE 20 2007 014 954 U1 describe the way in which additional lateral displacement of the drawer relative to the extension rail can also be implemented. In that arrangement, a receiving component is fixed to the drawer rear wall, the receiving component having a slot-shaped opening for receiving a plate connected to the drawer extension guide. The plate is displaceable by a predetermined amount within the slot-shaped opening whereby lateral displacement of the rear end region of the drawer is also possible.

SUMMARY OF THE INVENTION

It is an object of the present invention to provide—starting from the above-discussed state of the art—a structurally simple and compact adjusting device.

According to the invention, that object is accomplished by the features described below. Further advantageous configurations of the invention are recited in the appendant claims.

Thus the adjusting device has at least one holding projection which can preferably be fitted in a pre-bored bore in the drawer. The mounting portion arranged at the extension rail is adjustably arranged within that holding projection. In other words the mounting portion of the extension rail is mounted limitedly displaceably within the bore. In that way, there is proposed a very compact adjusting device, in which respect it is possible to dispense with an additional receiving plate which is mounted at the rear side of the drawer.

The bore for the holding projection can be provided, for example, in the drawer rear wall or also in the drawer side wall—for example in the end thereof, that is inward of the furniture carcass. The proposed extension guide is suitable in particular for mounting and adjusting a drawer made of a wood material and which can be releasably fixed as a common unit to the drawer extension guide, and can preferably be mounted and/or removed without the use of a tool.

In principle, a relative movement can be permitted between the holding projection and the mounting portion in at least one direction in space. A relative movement between the holding projection and the mounting portion, that is produced by the adjusting device, can therefore take place for example in a horizontal or also in a vertical direction. As the mounting portion mounted to the extension rail is in any case frequently adapted to be adjustable in height—as described in EP 1 147 725 B1 to the present applicant—it may be sufficient if the holding projection is mounted displaceably relative to the stationary mounting portion only in a substantially horizontal direction.

The holding projection to be fitted into the bore can be made from plastic while the mounting portion arranged within the holding projection has a metallic carrier which preferably has a casing of plastic at the free end region. The casing surrounding the metallic carrier can be in frictionally locking and/or at least partially positively locking engagement with the outer holding projection in the mounted position. To permit a sufficiently firm but adjustable mounting for the holding projection in relation to the mounting portion, the opening can have latching elements which are releasably latchable in various predetermined positions with corresponding latching parts of the mounting portion. In that respect, it may be desirable for either the carrier itself or the casing to have teeth or grooves which are in engagement with corresponding teeth or grooves on the holding projection. The holding projection which is fitted into the drawer is displaceable relative to the mounting portion by overcoming a certain frictional force, and can be arrested in the desired position.

The holding projection can be held in the mounted position within the bore with a press fit or with a sliding fit. The holding projection desirably has a cylindrical peripheral surface which in the mounted position is arranged within a cylindrical bore. The holding projection can therefore be in the form of a fixing peg which at the same time is part of the adjusting device. The holding projection can have an opening for accommodating the mounting portion, and the opening can extend substantially at a right angle to a longitudinal direction of the extension rail, the length of the opening being greater than the width of the mounting portion. In that way, an adjusting movement is possible between the holding projection and the mounting portion. A particular advantage of the invention is therefore also that the vertical gaps which occur between the front panel of the drawer and the front panels of adjacent drawers are also adjustable by horizontal displacement of the rear end region of the drawer.

The drawer according to the invention and the article of furniture according to the invention are characterised by at least one drawer pull-out guide of the kind described.

BRIEF DESCRIPTION OF THE DRAWINGS

Further details and advantages of the present invention are described with reference to the specific description hereinafter. In the drawings.

DETAILED DESCRIPTION OF THE INVENTION

Figure 1:
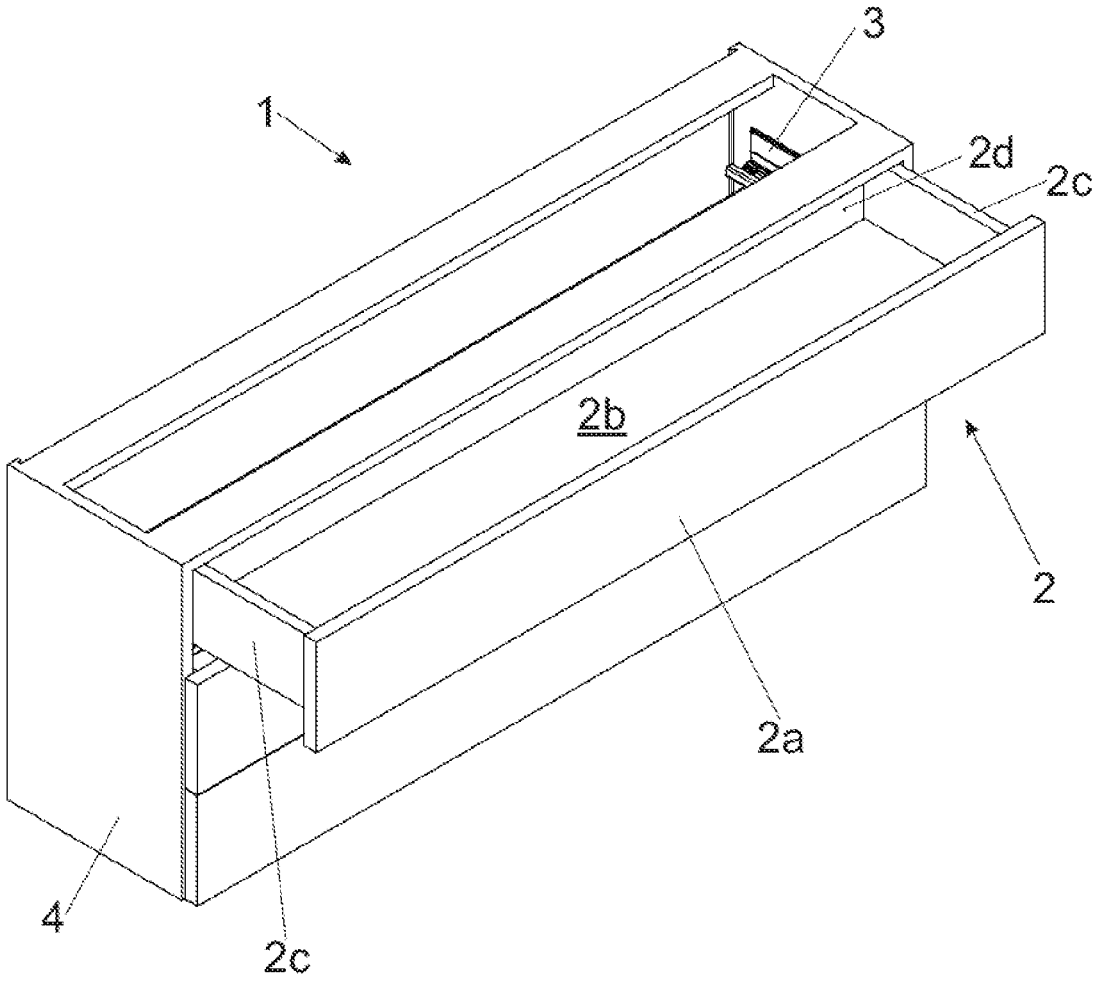
FIG. 1 shows a perspective view of an article of furniture with drawers which are mounted displaceably by way of pull-out-guides according to the invention.

FIG. 1 shows a perspective view of an article of furniture 1, wherein drawers 2 are mounted displaceably relative to a furniture carcass 4 by way of pull-out guides 3. In a known manner, the drawers 2 include a front panel 2*a*, a drawer bottom 2*b*, side walls 2*c* and a rear wall 2*d*. The pull-out guides 3 are fixed at opposite side walls of the furniture carcass 4. To adjust the inclination or the height position of the front panel 2*a*, EP 1 147 725 B1 already described the measure of adjustably raising or lowering the rearward end of the drawer 2 (that is to say the region of the rear wall 2*d*).

Figure 2:
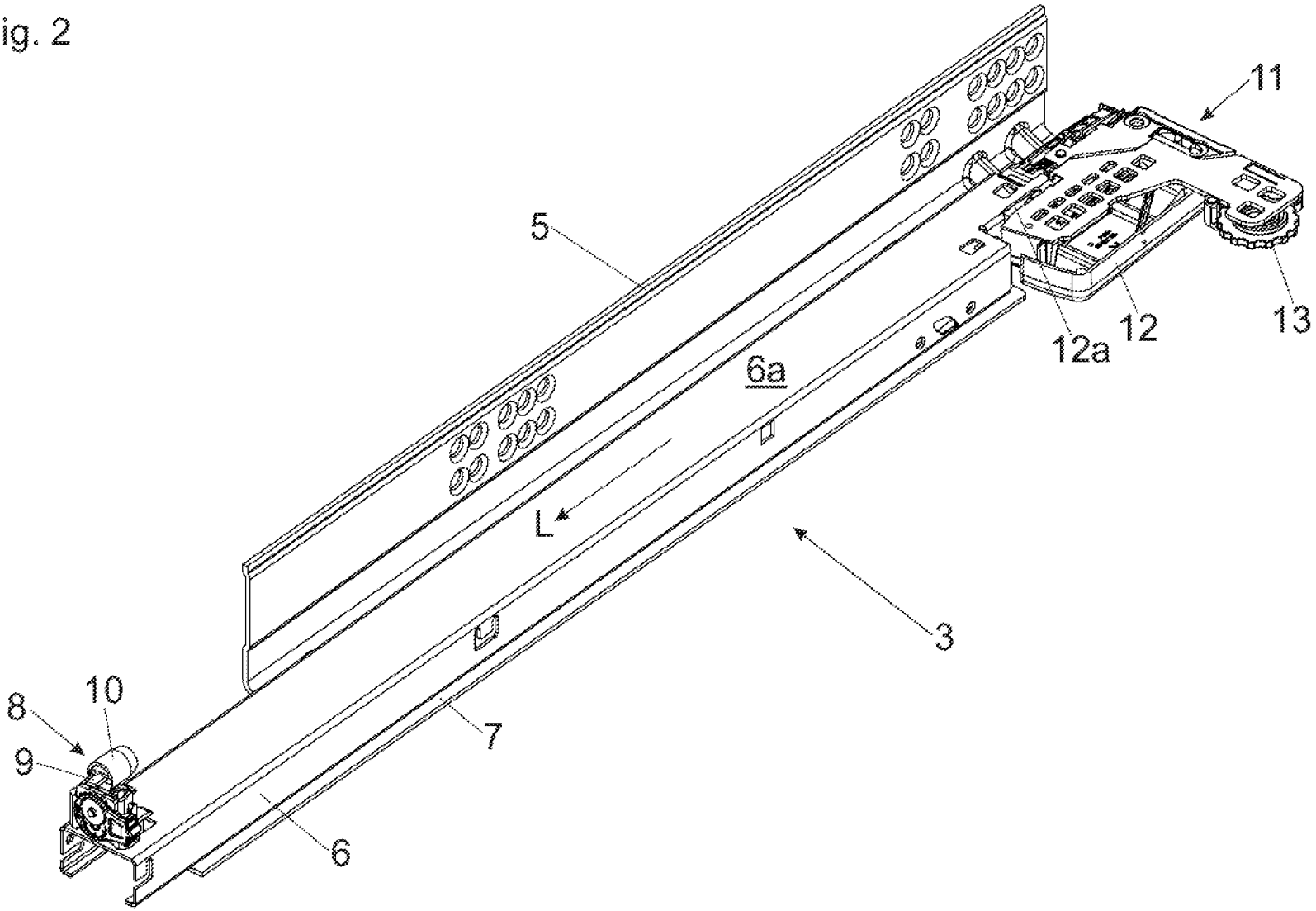
FIG. 2 shows a perspective view of a drawer pull-out guide.

FIG. 2 shows a perspective view of a possible embodiment of a pull-out guide 3 for drawers 2. The pull-out guide 3 includes a carcass rail 5 to be mounted to the furniture carcass 4 and at least one extension rail 6 displaceable relative thereto. Mounted displaceably between the carcass rail 5 and the extension rail 6 is an additional middle rail 7 in order to permit full extension of a drawer 2 which is or can be connected to the extension rail 6.

For mounting purposes, the drawer pull-out guide 3 is firstly pre-mounted to the furniture carcass, whereupon the drawer 2 is fitted onto the top side 6*a* of the extension rail 6 and displaced rearward in the direction of the arrow (L) until the adjusting device 8 mounted at the rearward end of the extension rail 6 limits the displacement travel of the drawer 2. The adjusting device 8 has a mounting portion 9 which extends in spaced relationship with the top side 6*a* of the extension rail 6 in a substantially horizontal direction. In particular, the adjusting device 8 has body portion, and the mounting portion 9 projects from the body portion into a holding projection 10. The mounting portion 9 is mounted at least partially within the holding projection 10. The holding projection 10 is provided to pass into (be received within) a corresponding bore (not shown here) of the drawer 2 so that the holding projection 10 is held in the mounted position within the bore with a press fit. For fixing the front end region of the drawer 2 relative to the extension rail 6, there is provided a coupling device 11 which is to be mounted to the drawer 2 (in particular in the lateral front region of the underside of the drawer bottom 2*b*). The drawer 2 can be releasably fixed in its entirety relative to the extension rail 6 by the coupling device 11, and can preferably be mounted without using a tool and can preferably be removed without using a tool. The coupling device 11 includes a gripping element 12 which is to be actuated manually and by which an arresting portion 12*a* of the coupling device 11 is movable from a latching opening of the extension rail 6 into a release position, whereupon the drawer 2 can be completely removed in its entirety from the extension guide 3. The coupling device 11 has an adjustment device 13 having an adjusting wheel, by which the coupling device 11 (and thus the drawer 2 connected thereto) is adjustable substantially at a right angle to the arrow (L) in a horizontal direction. In that way, lateral displacement of the drawer 2 is possible relative to the extension rail 6. At the same time, a vertically occurring gap between the front panel 2*a* and the front panels of adjacent drawers 2 can also be variably adjusted.

Figure 3A:
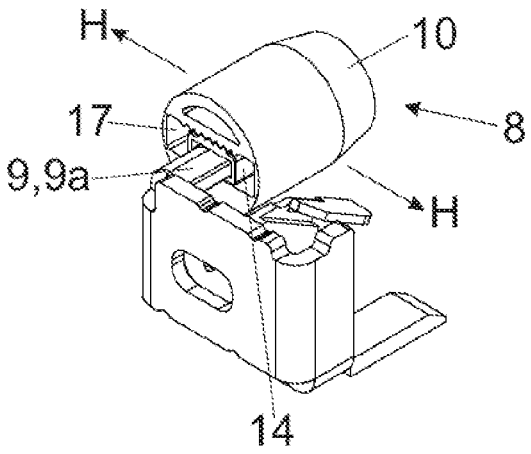
FIGS. 3*a*-3*d* show various views of an adjusting device for altering the position of the rear end region of the drawer.
Figure 3B:
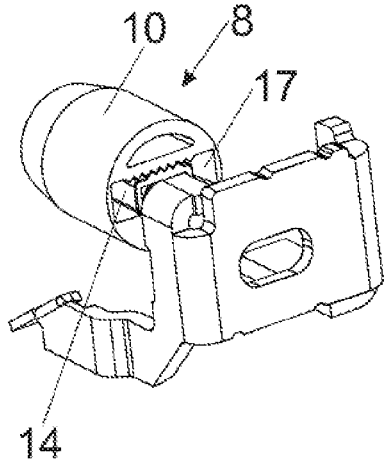
Figure 3C:
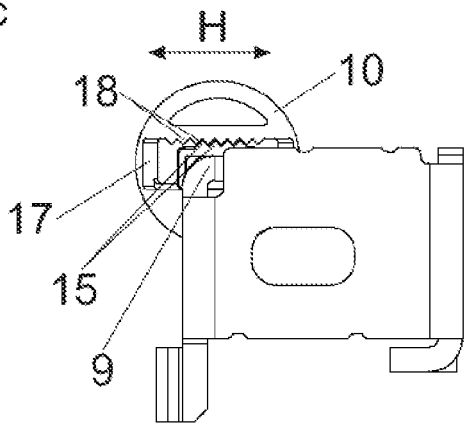

FIGS. 3*a*-3*d* show a possible embodiment of the first adjusting device 8 in various views. FIGS. 3*a* and 3*b* each show perspective views of a part of the adjusting device 8. The mounting portion 9 includes a metal carrier 9*a* which at its free end region can have a casing 14 of plastic. The casing 14 has latching parts 15 (FIG. 3*c*) which, in the mounted condition, are in engagement with corresponding latching elements 18 of an opening 17 in the holding projection 10. It is possible in that way to adjust the holding projection 10 (and therewith the drawer 2) relative to the stationary mounting portion 9 in a horizontal direction after a predetermined frictional force between the holding projection 10 and the casing 14 has been overcome. The holding projection 10 is therefore adjustable by a predetermined amount relative to the mounting portion 9 in the directions of the illustrated arrow (H) in various predetermined latching positions. The opening 17 of the holding projection 10 extends at a right angle to a longitudinal direction of the extension rail 6, wherein the length of the opening 17 is larger than the width of the mounting portion 9. FIG. 3*c* shows the adjusting device 8 from behind, wherein the holding projection 10 is displaceable in the direction indicated by the double-headed arrow (H) relative to the stationary mounting portion 9. Adjustment is preferably effected by manually applying pressure to the rear region of the side walls 2*c* of the drawer 2 (FIG. 1). It is to be noted that it is certainly possible to dispense with the arrangement of the casing 14, in which case it may be desirable for the latching parts 15 to be provided directly on the metallic carrier 9*a*.

Figure 3D:
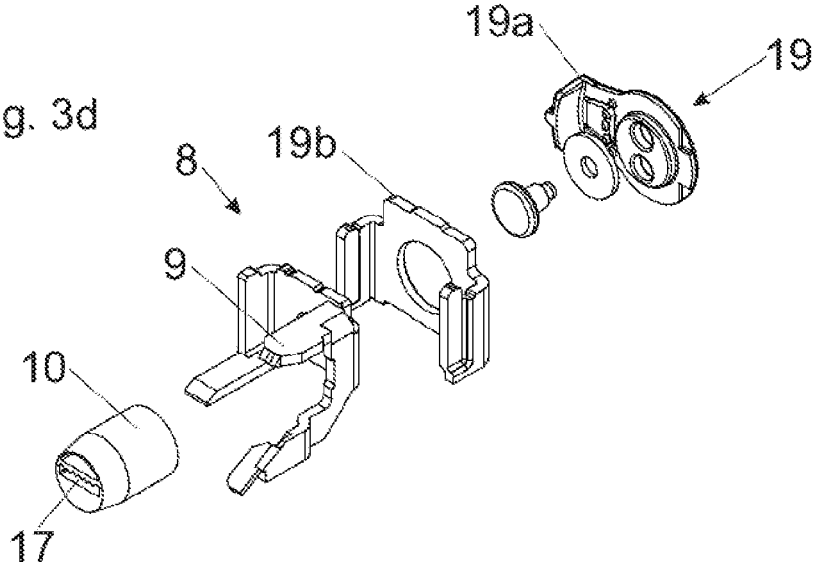

FIG. 3*d* shows an exploded view of the adjusting device 8 with the mounting portion 9 and the holding projection 10. It is possible to see the opening 17 in the holding projection 10 for receiving the mounting portion 9. In addition to the adjusting device 8, there is a further (second) adjustment device 19 by which the mounting portion 9 (and therewith the drawer 2) is also movable and adjustable in a vertical direction. The additional adjustment device 19 includes, for example, a self-locking eccentric adjusting member 19*a* by which the mounting portion 9 is height-adjustable relative to the stationary mounting assembly 19*b*. Such a mechanism has already been described in EP 1 147 725 B1 to the present applicant and does not need to be described in greater detail at this juncture.

Figure 4A:
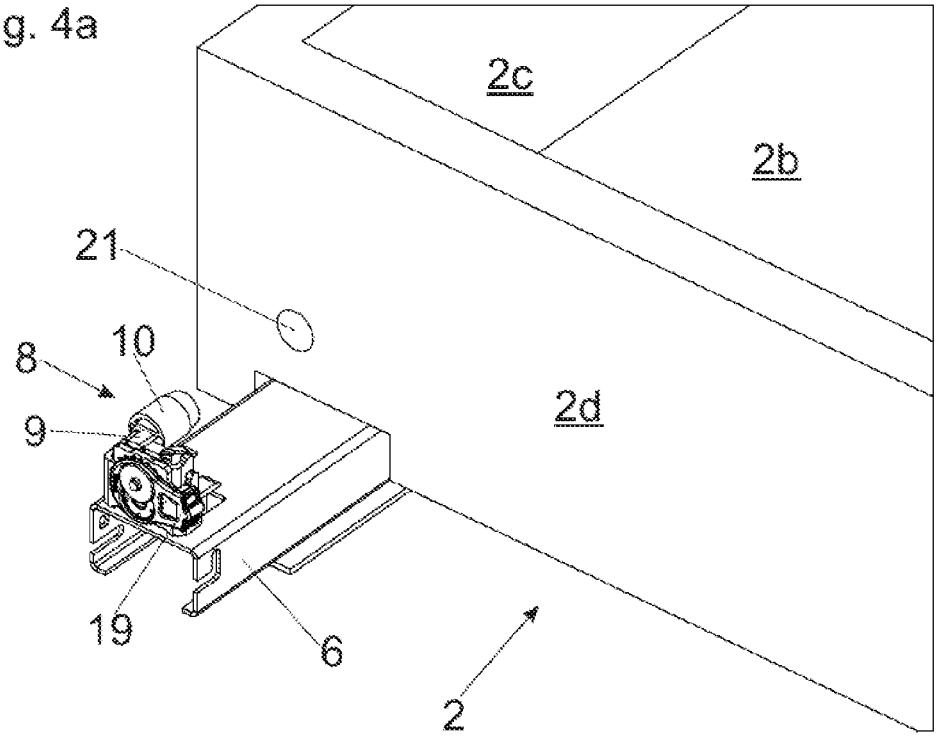
FIGS. 4*a*, 4*b* show two different possible options of mounting the drawer as perspective detail views.
Figure 4B:
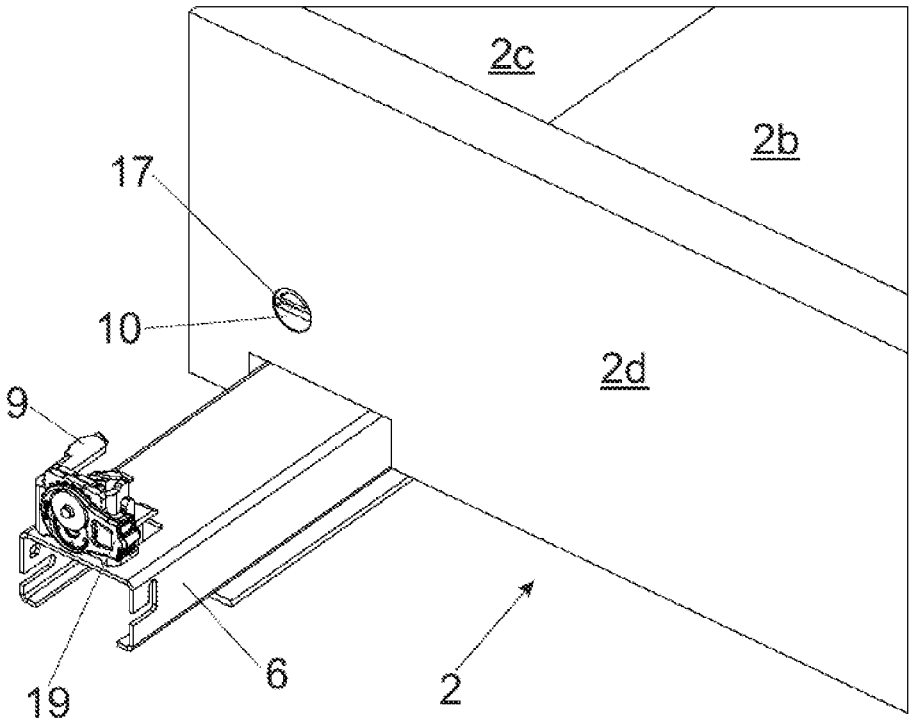

FIG. 4*a* shows the rearward end of the drawer 2, namely the rear side of the rear wall 2*d*, as a perspective view from the rear. It is possible to see in the rear wall 2*d* a pre-bored cylindrical bore 21, into which the holding projection 10 of the adjusting device 8 can pass upon further insertion movement of the drawer 2 relative to the extension rail 6, and is held therein by means of a press fit, a sliding fit or a wedge fit. The sliding fit or wedge fit of the holding projection 10 relative to the drawer 2 has the advantage that, upon release of the sliding fit, the holding projection 10 remains constantly on the mounting portion 9 and thus the drawer 2 at any time can be pushed onto the holding projection 10 or pulled off same. The mounted drawer 2 is adjustable with the first adjusting device 8 in a horizontal direction (that is to say laterally relative to the extension rail 6), while the second adjusting device 19 permits vertical adjustment of the mounting portion 9 (and therewith the drawer 2). FIG. 4*b* shows a possible variant in which the holding projection 10 has already been pre-fitted into the bore 21 in the drawer 2. Upon a pushing-in movement of the drawer 2, the horizontally oriented mounting portion 9 can pass into the opening 17 of the holding projection 10. After mounting has been effected, the drawer 2 is adjustable in a horizontal direction relative to the mounting portion 9, adjustment of the rearward end of the drawer 2 is also possible in a vertical direction by the second adjustment device 19. The design configuration can also be such that the holding projection 10 remains after initial mounting has been effected on the mounting projection 9 and thus the drawer 2 is separated from the holding projection 10 (as shown in FIG. 4*a*) and can be pushed thereonto at any time.

Figure 5A:
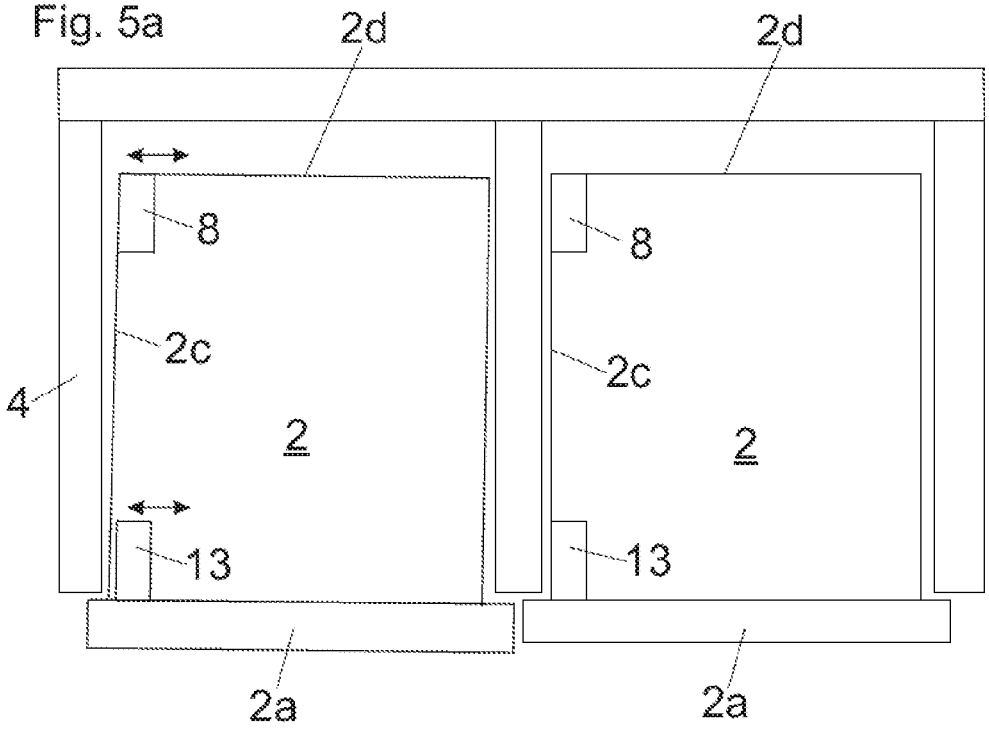
FIGS. 5*a*, 5*b* show diagrammatic top plan views of a drawer arrangement with a drawer having an inclined position and a properly adjusted drawer.
Figure 5B:
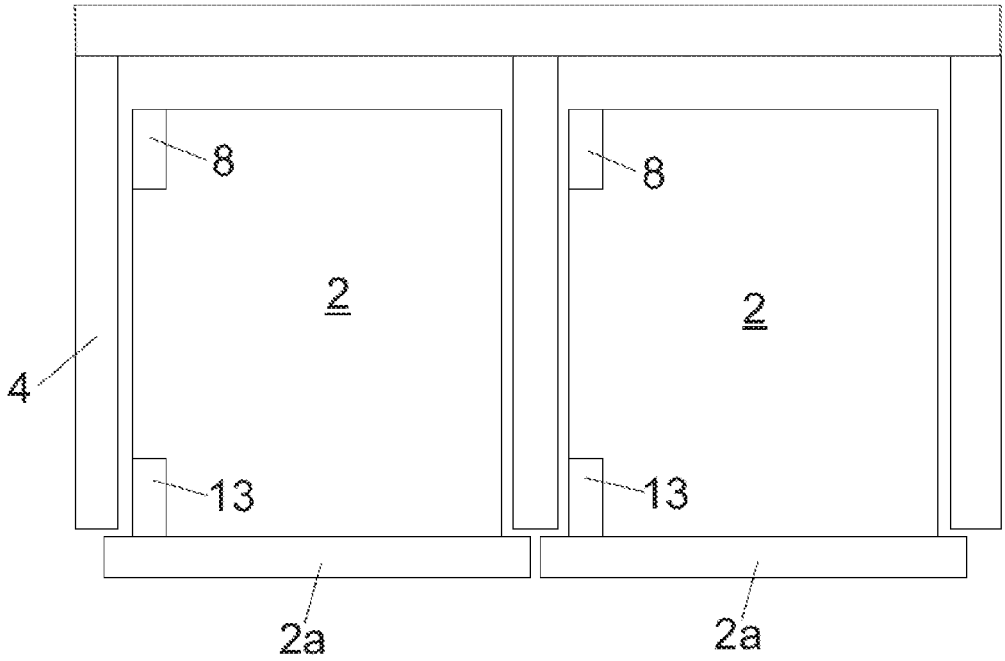

FIG. 5*a* diagrammatically shows a top plan view of the installation situation of two adjacent drawers 2. The two drawers 2 are mounted displaceably relative to a furniture carcass 4. The left-hand one of the two drawers 2 involves a visible inclined position. The rear end region of the drawer 2 can be adjusted at least in a horizontal direction by the first adjusting device 8 in the region of the rear wall 2*d*, while the front region of the drawer 2 is adjustable at least in a lateral direction by the front adjustment device 13 arranged in the front end region of the drawer 2 (FIG. 2). Lateral displacement of the drawer 2 relative to the movable extension rail 6 is possible by the two adjusting devices 8 and 13 so that the side wall 2*c* of the drawer 2 can be oriented parallel to the side wall of the furniture carcass 4. The lateral directions of movement are symbolically indicated by the double-headed arrows shown in relation to the adjusting devices 8, 13. The properly adjusted drawer arrangement is shown in FIG. 5*b*. Tilt-free movement of the drawer 2 and parallel orientation of the front panel 2*a* relative to the front edge of the carcass can be made possible by the two adjusting devices 8, 13.

The present invention is not limited to the illustrated embodiments, and includes or extends to all variants and technical equivalents which can fall within the scope of the claims appended hereto. The positional references adopted in the description such as for example up, down, lateral and so forth are also related to the usual position of installation of the drawer 2 or the directly described and illustrated Figure and are to be appropriately transferred to the new position upon a change in position. The adjusting device 8 can also be used for vertical adjustment of the drawer 2, which can be particularly easily implemented by a vertically extending opening 17 in the holding projection 10.

The invention claimed is:

1. A pull-out guide for a drawer, comprising:

a carcass rail to be fixed to a furniture carcass;

an extension rail displaceable relative to said carcass rail; and an adjusting device for adjusting a position of the drawer to be connected to said extension rail, said adjusting device including:

a holding projection to be fitted into a bore in the drawer; and a mounting portion mounted at a rear end of said extension rail, said mounting portion extending in a substantially horizontal direction along a longitudinal axis of said extension rail and being spaced apart from a top side of said extension rail, said mounting portion being adjustably arranged within said holding projection to be fitted within the bore when mounted, and said mounting portion having a longitudinal axis substantially parallel to said longitudinal axis of said extension rail;

wherein said holding projection has an opening for receiving said mounting portion, said opening having a longitudinal axis extending at a substantially right angle with respect to said longitudinal axis of said extension rail, a length of said opening being greater than a width of said mounting portion, said mounting portion being adjustably mounted within said opening of said holding projection so that said mounting portion is displaceable relative to said holding projection in a substantially horizontal direction.

2. The pull-out guide according to claim 1, wherein said holding projection is made of plastic material.

3. The pull-out guide according to claim 1, wherein said mounting portion has a metallic carrier, said metallic carrier having a free end portion with a plastic casing.

4. The pull-out guide according to claim 1, wherein said holding projection is configured to be held within the bore with at least one of a press fit, a sliding fit, and a wedge fit when mounted.

5. The pull-out guide according to claim 1, wherein said holding projection has a cylindrical peripheral surface to be arranged within a cylindrical bore when mounted.

6. The pull-out guide according to claim 1, wherein said mounting portion is configured to be adjustably arranged within a bore in a wood rear wall of the drawer when mounted.

7. The pull-out guide according claim 1, wherein said mounting portion is held relative to said holding projection by frictional engagement between said mounting portion and said holding projection.

8. The pull-out guide according to claim 1, wherein said holding projection has latching elements configured to be releasably latchable in various positions with corresponding latching parts of said mounting portion.

9. The pull-out guide according to claim 1, wherein said adjustment device comprises a first adjustment device, said pull-out guide further comprising a second adjustment device for adjusting said mounting portion with respect to said extension rail in a substantially vertical direction.

10. The pull-out guide according to claim 1, wherein said adjustment device further includes a body portion, said mounting portion extending from said body portion along said longitudinal axis of said extension rail into said holding projection.

11. The pull-out guide according to claim 10, wherein said holding projection has latching elements and said mounting portion has corresponding latching parts, said latching elements of said holding projection being configured to adjustably engage said latching parts of said mounting portion so as to allow adjustment of a position of said mounting portion relative to said holding projection.

12. A drawer comprising said pull-out guide of claim 1.

13. An article of furniture comprising said drawer of claim 12.

* * * * *